US005604809A

United States Patent [19]

Tsubonuma et al.

[11] Patent Number: 5,604,809

[45] Date of Patent: Feb. 18, 1997

[54] SOUND FIELD CONTROL SYSTEM

[75] Inventors: Hiroshi Tsubonuma; Hirofumi Yanagawa, both of Saitama-ken, Japan

[73] Assignee: Pioneer Electronic Corporation, Tokyo, Japan

[21] Appl. No.: 550,104

[22] Filed: Oct. 30, 1995

[30] Foreign Application Priority Data

Oct. 31, 1994 [JP] Japan ..... 6-267272

[51] Int. Cl.[6] ..... H04R 5/00

[52] U.S. Cl. ..... 381/17; 381/1; 381/63

[58] Field of Search ..... 381/1, 17, 18, 381/26, 63, 61

[56] References Cited

U.S. PATENT DOCUMENTS 4,355,203 10/1982 Cohen ..... 381/1
5,119,420 6/1992 Kato et al. ..... 381/1
5,206,910 4/1993 Hamada et al. ..... 381/26
5,546,465 8/1996 Kim ..... 381/17

*Primary Examiner*—Curtis Kuntz
*Assistant Examiner*—Vivian Chang
*Attorney, Agent, or Firm*—Nikaido, Marmelstein, Murray & Oram LLP

[57] ABSTRACT

First and second processing circuits are provided for carrying out a reverberation process of an input signal, and first and second filters are provided for applying amplitude characteristics to output signals of the first and second processing circuits. A first adder is provided for adding an output signal of the first processing circuit with an output signal of the second filter at opposed phase, and a second adder is provided for adding an output signal of the first filter with an output signal of second processing circuit in-phase. First and second speakers are provided to receive output signals of the first and second adders. The first and second amplitude characteristics are determined in accordance with a correlation coefficient of sound pressures of sounds from the first and second speakers.

3 Claims, 4 Drawing Sheets

SOUND FIELD CONTROL SYSTEM

BACKGROUND OF THE INVENTION

The present invention relates to a sound field control system wherein a monophonic audio signal is converted into stereo-simulated signals.

Spacial sound impression which a listener feels depends on auditory sensations of the ears. When sounds of the same amplitude reach both ears at the same phase, the listener feels as through the sound is coming from the center in front of him, lacking in lateral expanse. On the other hand, when complex sounds of the same amplitude at a various phases are heard, a lateral expanse is sensed.

In the case of steady noise such as white noise and pink noise, the extent of the lateral expanse can be expressed using as a factor only an interaural correlation coefficient $\phi xy(\tau)$ of sound heard by both ears. Namely, $$\phi_{xy}(\tau)=\frac{\lim_{T\to\infty}\frac{1}{T}\int_0^T x(t)\cdot y(t+\tau)dt}{\sqrt{\lim_{T\to\infty}\frac{1}{T}\int_0^T x^2(t)dt}\sqrt{\lim_{T\to\infty}\frac{1}{T}\int_0^T y^2(t)dt}} \quad (1)$$

wherein, x(t) and y(t) are audio signals reproduced from the right and left loudspeakers, respectively. The value $\phi xy(\tau)$ when $\tau$ is zero represents the correlation coefficient.

However, such a simple physical value is not sufficient to express the lateral expanse felt when a musical sound including a large quantity of impulsive components is heard. Moreover, a feeling of lateral expanse differs in the case of musical sound with transient or impulse sound and in the case of steady noises although the value of the correlation coefficient may be the same.

This is due to the fact that, although there exist reflected sounds from various directions, the human ear is able to discern the direction from which came a sound that first reached the ear, that is, a direct sound of a sound source. More particularly, the human auditory system operates to render the direction from which the initial reflected sound following the direct sound obscure, and to compensate the volume of the direct sound by the reflected sound. Such a characteristics of the auditory system is an important factor in quantitatively expressing the sense of expanse of the musical sounds.

In order to achieve such a sense of lateral expanse, there has been proposed a sound field generating systems such as a surround, presence stereo and omni-sound system for creating the sound field. Each of these systems uses a two-channel audio signal as a sound source. The audio signal is processed so that a component expressing a sense of sound field is effectively strengthened.

Furthermore, there is proposed a sound field control (SFC) system wherein acoustic conditions are added to the two-channel audio signal so as to simulate the effects caused in various reproducing locations. For example, the audio signal is processed by a DASP based on data on sound field collected by way of a proximity four point microphone recording system in famous concert halls of the world, or on data simulated by a computer. The sound reproduced from the processed audio signal is emitted from four speakers, thereby giving the listener a feeling as though he is actually in one of these halls.

Japanese Patent Application Laid Open No. 6-269098 discloses such a SFC system as shown in FIG. 4. Referring to FIG. 4, a monophonic audio signal S(t) is fed to a first SFC processing circuit 10 and a second SFC processing circuit 20. The first and second SFC processing circuits 10 and 20 process the signal S(t) in a different manner so that stereo-simulated signals $S_1(t)$ and $S_2(t)$ having a small correlation coefficient therebetween are generated. The stereo-simulated signals $S_1(t)$ and $S_2(t)$ are fed to loudspeakers 12 and 22 through respective amplifiers 11 and 21 so as to be reproduced. Namely, in the SFC system, the signals are controlled so as to set the transient interaural correlation coefficient at an optimum value to provide a sense of lateral expanse.

More particularly, FIG. 5 shows the first and second SFC processing circuit 10 and 20 in detail. The SFC processing circuit 10 comprises a left delay element 11 having a plurality of output terminals $LO_1$ to $LO_n$ so that a plurality of delay times are provided. Similarly, the SFC processing circuit 20 comprises a right delay element 11R having a plurality of terminals $RO_1$ to $RO_n$. The delay time becomes longer as the distance between each output terminal and the corresponding input terminal Lch IN or Rch IN becomes longer.

Output terminals $LO_1$ and $LO_2$ of the delay element 11 and an output terminal $RO_5$ of the delay element 11 are connected to an adder 4 so as to generate a first left channel reverberation signal. Output terminals $LO_i$ and $LO_{i+1}$ of the delay element 11 and output terminals $RO_1$ and $RO_2$ are connected to an adder 5 so as to generate a first right channel reverberation signal. Similarly, output terminals $LO_k$ and $LO_{k+1}$ and $RO_t$ and $RO_{t+1}$ are connected to an adder 6 to generate a second left channel reverberation signal. Output terminals $LO_j$, $RO_u$ and $RO_{u+1}$ are connected to an adder 7 to generate a second right channel reverberation signal.

The first reverberation signals from the adders 4 and 5 have a relatively small delay while the second reverberation signals from the adders 6 and 7 have a large delay.

The first left and right channel reverberation signals from the adders 4 and 5, respectively, are fed to a first function of correlation control filter 3, and second left and right channel reverberation signals from the adders 6 and 7, respectively, are fed to a second function of correlation control filter 2.

The first right and left reverberation signals with a smaller delay are controlled to have a predetermined interaural correlation coefficient and the second reverberation signal with a large delay are controlled to have a correlation coefficient corresponding to the delay, thereby to provide an appropriate sense of expanse.

The principle of the above-described conventional system is based on a transient interaural correlation coefficient. The filters 2 and 3 control the interaural correlation coefficient to coincide with that of a concert hall said to have excellent acoustics, so that a similar acoustic effect is obtained in an ordinary room.

The correlation coefficient control filters 2 and 3 control the signals by SFC processing and adding a negative-phase sequence component. However, the frequency response in accordance with the correlation coefficient is not considered, so that the sense of expansion is not sufficient.

SUMMARY OF THE INVENTION

An object of the present invention is to provide an improved sound field control system wherein a further lateral expanse of sound is sensed by a listener.

According to the present invention, there is provided a sound field control system comprising, a first processing circuit for carrying out a reverberation process of an input signal to produce a first stereo-simulated signal, a second processing circuit for carrying out a reverberation process of the output signal to produce a second stereo-simulated signal, a first filter for applying a first amplitude characteristic to the first stereo-simulated signal to produce a first amplitude-controlled signal, a second filter for applying a second amplitude characteristic to the second stereo-simulated signal to produce a second amplitude-controlled signal, a first adder for adding the first stereo-simulated signal with the second amplitude-controlled signal at opposed phase, a second adder for adding the second stereo-simulated signal with the first amplitude-controlled signal at in-phase, a first speaker to receive an output signal of the first adder, a second speaker to receive an output signal of the second adder. The first and second amplitude characteristics are determined in dependency on a correlation coefficient of sound pressures of sounds from the first and second speakers.

The other objects and features of this invention will become understood from the following description with reference to the accompanying drawings.

DETAILED DESCRIPTION OF THE PREFERRED EMBODIMENTS

Figure 4:
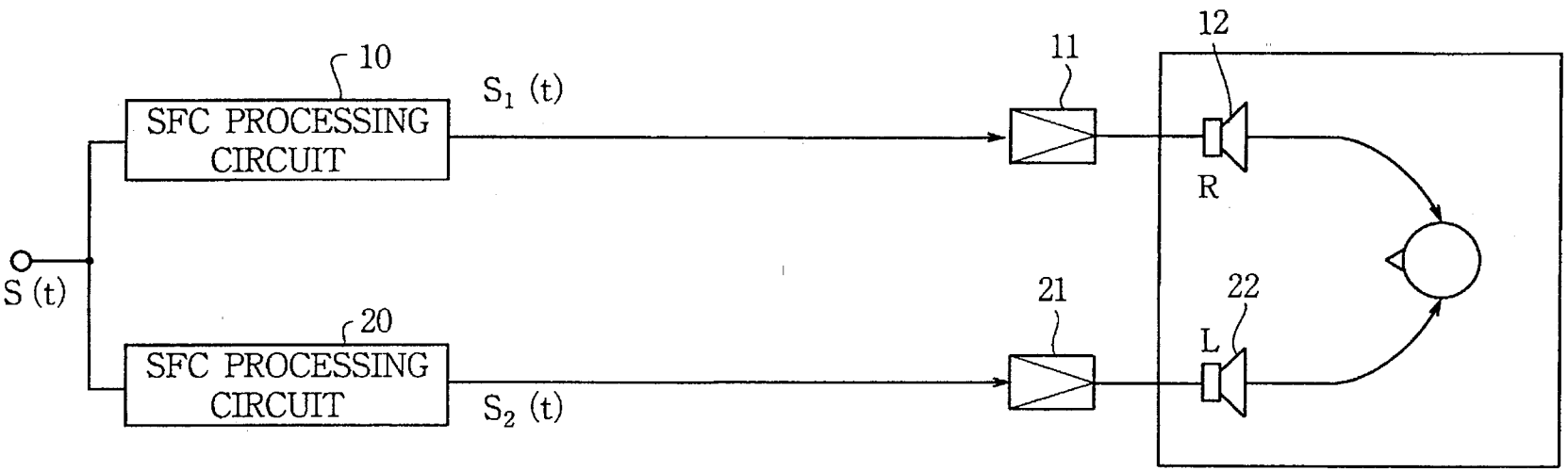
FIG.4 PRIOR ART
FIG. 4 is a block diagram showing a conventional sound field control system.
Figure 5:
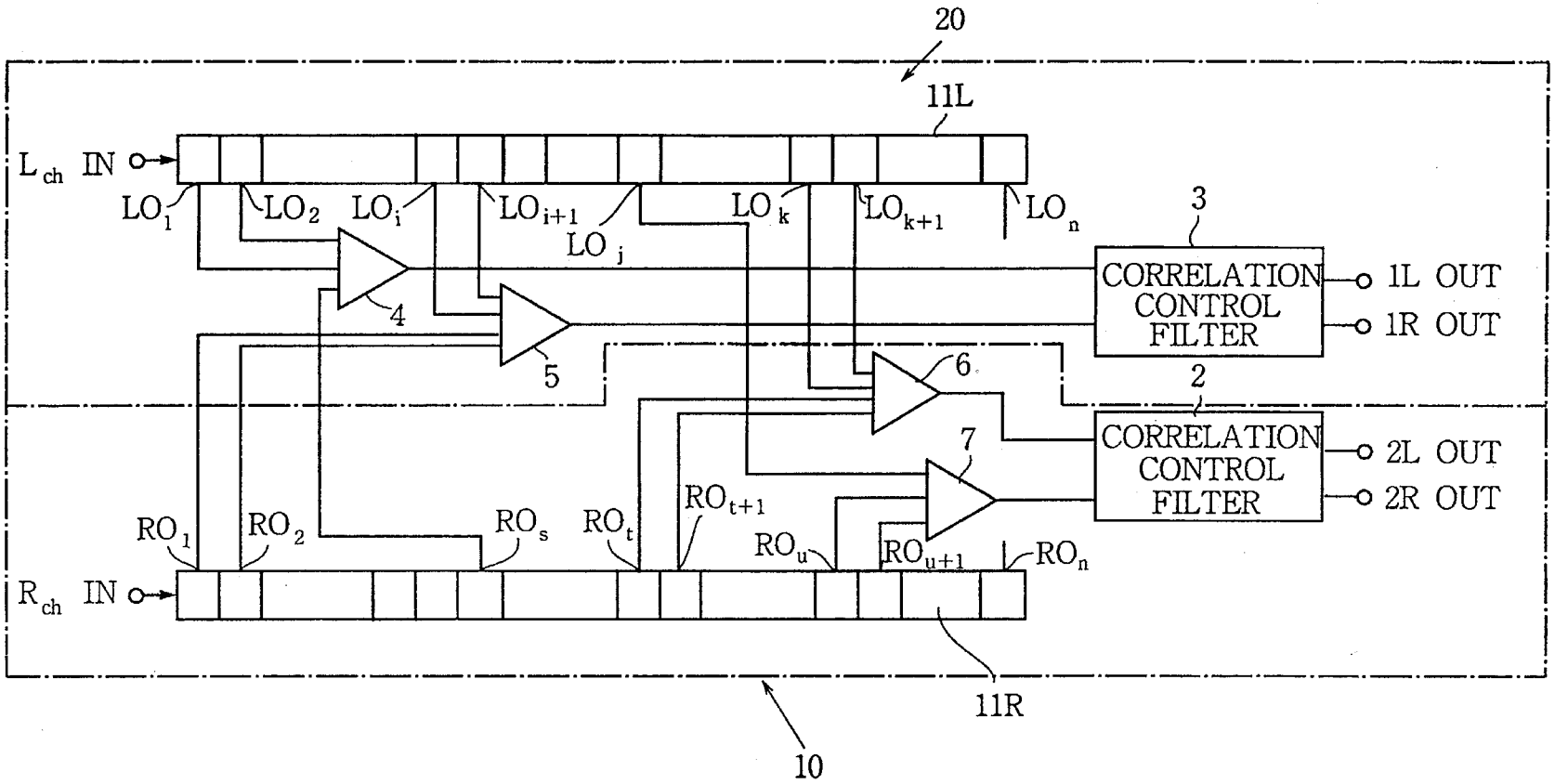
FIG.5 PRIOR ART
FIG. 5 is a block diagram showing a detailed part of the conventional sound field control system of FIG. 4.

The sound field generating system of the present invention is described hereinafter with reference to FIG. 1 wherein the same references as in FIG. 4 designates the same parts as in FIG. 4.

Figure 1:
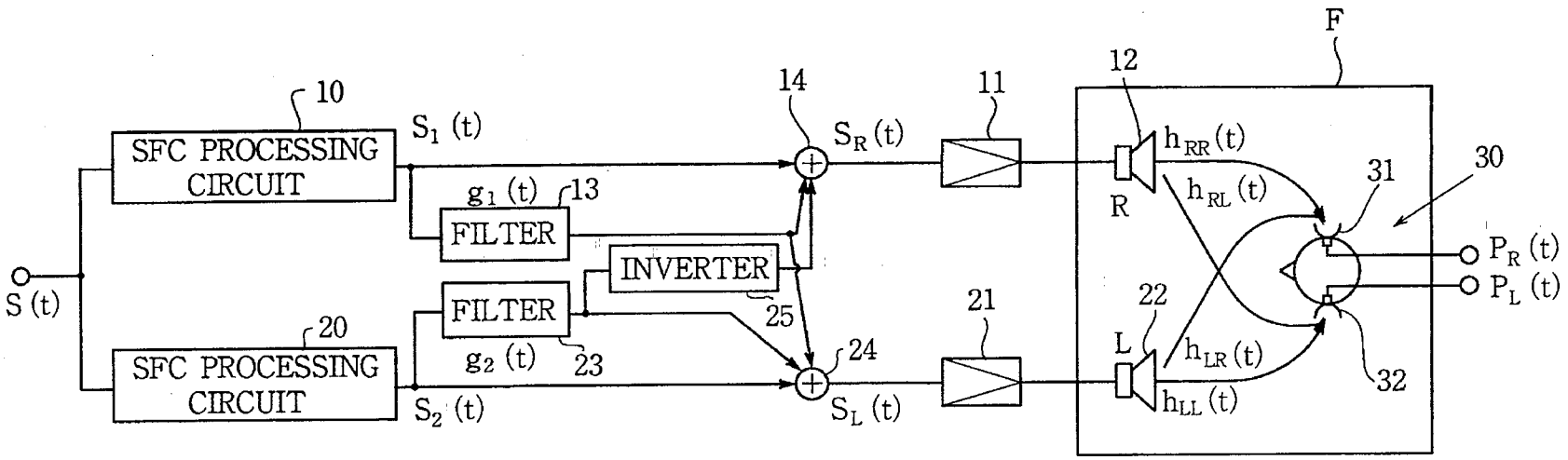
FIG. 1 is a block diagram showing a sound field control system according to the present invention.

Referring to FIG. 1, the sound field generating system of the present invention comprises the first and second SFC processing circuits 10 and 20 for carrying out reverberation process of an input signal S(t) to produce first and second stereo-simulated signals $S_1(t)$, and $S_2(t)$, respectively. The first stereo-simulated signal $S_1(t)$ and the second stereo-simulated signal $S_2(t)$ are so processed that the correlation coefficient is reduced. A first filter 13 and second filter 23 are provided for applying amplitude characteristic to the first and second stereo-simulated signals $S_1(t)$ and $S_2(t)$, respectively. The first stereo-simulated signal $S_1(t)$ is fed to an adder 14 directly and through the first filter 13 where the amplitude thereof is controlled. The amplitude-controlled signal is further fed to an adder 24 at in-phase with the second stereo-simulated signal $S_2(t)$. The second stereo-simulated signal $S_2(t)$ is fed to the adder 24 directly and though the second filter 23 where the amplitude thereof is controlled. The amplitude-controlled second stereo-simulated signal is further fed to the adder 14 through an inverter 25 at opposite phase with the signal $S_1(t)$. Accordingly, the adder 14 produces a right channel output signal $S_R(t)$ and the adder 24 produces the left channel output signal $S_L(t)$. The right and left channel output signals $S_R(t)$ and $S_L(t)$ are amplified by the amplifiers 11 and 21, and reproduced by the loudspeakers 12 and 22 provided in a reproducing sound field F, respectively.

Explaining the first and second filters 13 and 23 for setting the amplitude characteristics of the output signals, the right channel output signals $S_R(t)$ and the left channel output signal $S_L(t)$ are expressed as follows.

$$S_R(t)=S_1(t)+S_1(t)*g_1(t)-S_2(t)*g_2(t)$$

$$S_L(t)=S_2(t)+S_1(t)*g_1(t)+S_2(t)*g_2(t) \quad (2)$$

wherein $g_1(t)$ and $g_2(t)$ are time-domain expression, that is, impulse response of the filters 13 and 23, and * shows a convolution. The impulse response represents a response of the filters 13 and 23 when an impulse signal is applied thereto. Since the impulse signal has a constant energy component in an infinite frequency range, the impulse response represents a frequency characteristic of the system.

In the system of FIG. 1, the sound pressures $P_R(t)$ and $P_L(t)$ at both ears of a listener, which are assumed as sound pressure at a pair of microphones 31 and 32 mounted on a during head 30 in the sound field F, can be theoretically expressed as follows.

$$P_R(t)=S_R(t)*h_{RR}(t)+S_L(t)*h_{LR}(t)$$

$$P_L(t)=S_L(t)*h_{LL}(t)+S_R(t)*h_{RL}(t) \quad (3)$$

wherein $h_{RR}(t)$ and $h_{RL}(t)$ are impulse responses of the microphone 31, and $h_{LR}(t)$ and $h_{LL}(t)$ are impulses responses of the microphone 32.

From the formulae (3), it will be understood that the sound pressures $P_R$ and $P_L$ change in accordance with the output signals $S_R$ and $S_L$.

On the other hand, an interaural correlation coefficient $\rho_{LR}$ can be obtained from the formula (1) based on the actual sound pressures $P_R$ and $P_L$ measured by the microphones 31 and 32.

Figure 2:
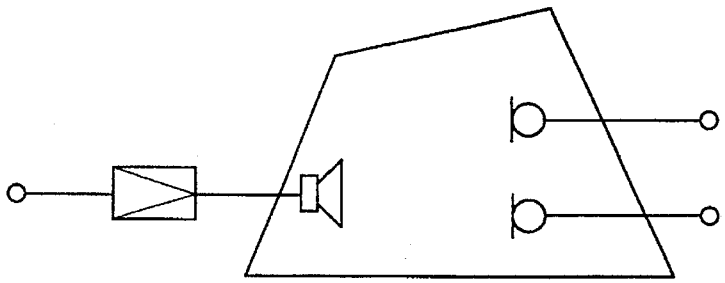
FIG. 2 is an illustration describing the principle of the sound field control system of FIG. 1.

In the present invention, the interaural correlation coefficient $\rho_{LR}$ obtained when a stationary signal such as a random noise is reproduced in a diffuse field as shown in FIG. 2 is adjusted so as to approximate a spacial correlation coefficient ρd obtained in a diffuse field which is typically represented by a reverberation room.

The spacial correlation coefficient ρd is expressed as follows.

$$\rho d=\sin(kr)/kr$$

wherein k is a wavelength constant expressed as $k=\omega/c=2\pi f/c$, where c is the sound velocity, and r is a distance between the ears.

The adjustment of the interaural correlation coefficient $\rho_{LR}$ is performed by changing the signals $S_R$ and $S_L$.

When an in-phase component which is to be added at the adders 14 and 24 is increased at the first filter 13, the interaural correlation coefficient $\rho_{LR}$ obtained from the formula (1) becomes large. When a opposite phase component which is to be added at the adders 14 and 24 is increased at the second filter 23, the interaural correlation coefficient $\rho_{LR}$ becomes small.

Thus, the filters 13 and 23 are set so that the interaural correlation coefficient $\rho_{LR}$ approximates the spacial correlation coefficient ρd.

The first and second filters 13 and 23 further control the interaural correlation coefficient $\rho_{LR}$ in accordance with the frequency. Namely, the frequency response of the interaural correlation coefficient $\rho_{LR}$ to the stationary random signal within a narrow band is approximated to the spacial correlation coefficient ρd in the diffuse field.

More particularly, the phase characteristics of an amplitude frequency response $H_1(W)$ of the first filter 13 and an amplitude frequency response $H_2(W)$ of the second filter 23 are assumed to be both linear. When $H_1(W)>H_2(W)$, the in-phase component is increased in the output signal so that the interaural correlation coefficient $\rho_{LR}$ is increased. On the other hand, when $H_1(W)<H_2(W)$, the opposite phase component is increased in the output signal, thereby decreasing the interaural correlation coefficient $\rho_{LR}$. The interaural correlation coefficient does not change when $H_1(W)=H_2(W)$.

Thus, the levels of the in-phase and opposite phase components are controlled at each frequency W. Hence, the interaural correlation coefficient is so controlled that the interaural correlation coefficient $\rho_{PLR}$ at the stationary random signal becomes equal to the spacial correlation ρd in the diffuse field. Namely, when the interaural correlation coefficient $\rho_{LR}$ which is obtained through the process of the filters 13 and 23 set for a certain frequency is smaller than the desired value, the filters are reset to relatively increase the in-phase component, and vice versa. Thus, the filters 13 and 23 are designed to control the distribution of the in-phase and opposite phase levels in each of the frequency ranges.

Figure 3A:
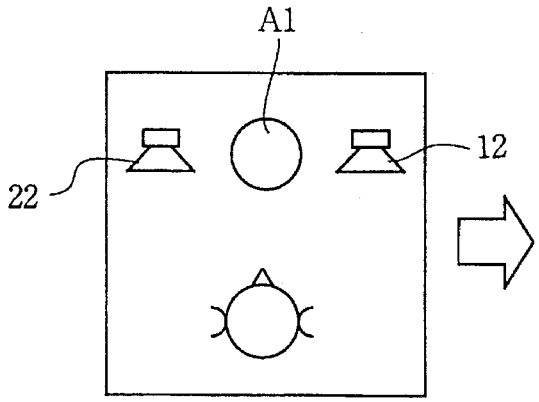
FIGS. 3*a* and 3*b* are diagrams each explaining an expanse of sound in a conventional system and in the system of the present invention, respectively.
Figure 3B:
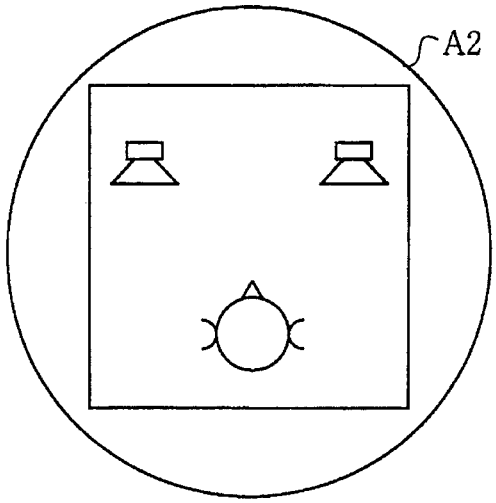

In operation, the monophonic signal S(t) fed to the first and second SFC processing circuits 10 and 20 are processed so as to be added the reverberation effect. The resultant stereo-simulated right signal $S_1(t)$ from the first SFC processing circuit 10 is fed to the first filter 13 so that the predetermined amplitude characteristic is added thereto. The stereo-simulated left signal $S_2(t)$ from the second SFC processing circuit 20 is fed to the second filter 23 so as to be added a predetermined amplitude characteristic. The stereo-simulated signal $S_1(t)$ from the first processing circuit 10, the output signal of the first filter 13, and the output signal of the second filter 23 which is inverted at the inverter 25 are added together at the adder 14 to form the right channel output signal $S_R(T)$, which is reproduced at the right speaker 12. The stereo-simulated signal $S_2(t)$ from the second processing circuit 20, the output signal of the first filter 13, and the output signal of the first filter 13 are added together at the adder 24 to form the left channel output signal $S_L(t)$, which is reproduced at the left speaker 22. Hence, whereas the sound is heard as though a sound image is positioned between the speakers 12 and 22 in the conventional system as shown by an area A1 in FIG. 3*a*, in the present invention, the sound image is expanded covering the entire environment, as shown by an area A2 in FIG. 3*b*.

The direct sound may be reproduced though another channel, or added to the processed signal in order to improve the sense of lateral expanse without losing an appropriate sound localization. Accordingly, when converting a monophonic signal into a stereo-simulated signal as in the presently described embodiment, the feeling of lateral expanse of the sound can be successfully achieved.

From the forgoing it will be understood that the present invention provides a sound field control system wherein the sounds emitted from the right and left loudspeakers are not only imparted with a reverberation effect, but also controlled in accordance with the frequency response. Namely, the interaural correlation coefficient is approximated to spacial correlation coefficient in the diffuse field. Hence a feeling of lateral expanse is improved.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A sound field control system comprising:

a first processing circuit for carrying out a reverberation process of an input signal to produce a first stereo-simulated signal;

a second processing circuit for carrying out a reverberation process of the output signal to produce a second stereo-simulated signal;

a first filter for applying a first amplitude characteristic to the first stereo-simulated signal to produce a first amplitude-controlled signal;

a second filter for applying a second amplitude characteristic to the second stereo-simulated signal to produce a second amplitude-control signal;

a first adder for adding the first stereo-simulated signal with the second amplitude-controlled signal at opposed phase;

a second adder for adding the second stereo-simulated signal with the first amplitude-controlled signal at in-phase;

a first speaker to receive an output signal of the first adder;

a second speaker to receive an output signal of the second adder;

means for determining the first and second amplitude characteristics in dependency on a correlation coefficient of sound pressures of sounds from the first and second speakers.

2. The system according to claim 1 wherein the first adder is further applied with the first amplitude-controlled signal, and the second adder is further applied with the second amplitude-controlled signal.

3. The system according to claim 1 wherein the first and second amplitude characteristics are determined so that the correlation coefficient of said sound pressures approximates a correlation coefficient between two points in a diffuse field.

* * * * *